US010704842B2

(12) United States Patent
Tian

(10) Patent No.: US 10,704,842 B2
(45) Date of Patent: Jul. 7, 2020

(54) SIDE PLATE END TAB FOR HEAT EXCHANGER

(71) Applicants: DENSO International America, Inc., Southfield, MI (US); DENSO CORPORATION, Kariya, Aichi-pref. (JP)

(72) Inventor: Yilin Tian, Farmington, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 51 days.

(21) Appl. No.: 16/106,894

(22) Filed: Aug. 21, 2018

(65) Prior Publication Data

US 2020/0064084 A1 Feb. 27, 2020

(51) Int. Cl.
*F28F 9/00* (2006.01)
*F28F 9/02* (2006.01)

(52) U.S. Cl.
CPC ..... *F28F 9/002* (2013.01); *F28F 9/0224* (2013.01); *F28F 9/0256* (2013.01); *F28F 2009/0292* (2013.01); *F28F 2275/122* (2013.01); *F28F 2280/00* (2013.01)

(58) Field of Classification Search
CPC ..... F28F 9/0131; F28F 9/0224; F28F 9/0226; F28F 2009/0285; F28F 2225/06; F28F 2225/04; F28F 2225/08; F28F 2275/08; F28F 2275/085; F28F 2280/06; F28F 9/002; F28F 2275/122; F28F 2280/00
USPC ..... 165/81; 29/890.052
See application file for complete search history.

(56) References Cited

U.S. PATENT DOCUMENTS 4,534,407 A * 8/1985 Lardner ..... F28D 1/05316 165/149
4,876,778 A * 10/1989 Hagihara ..... B21D 53/085 29/890.046
5,535,819 A * 7/1996 Matsuura ..... F28F 9/001 165/149
6,736,193 B2 5/2004 Kodumudi et al.
6,786,275 B2 9/2004 Dey et al.
7,059,050 B2 * 6/2006 Calhoun ..... F28D 1/05366 165/149
7,954,543 B2 6/2011 Hernandez et al.
8,794,300 B2 * 8/2014 Irmler ..... F02B 29/0475 165/140
2006/0070725 A1 4/2006 Kroetsch et al.
2006/0236538 A1 10/2006 Nakagawa
(Continued)

FOREIGN PATENT DOCUMENTS

FR 2927987 A1 * 8/2009 ..... F28F 9/0226

OTHER PUBLICATIONS

FR-2927987-A1—English Machine translation (Year: 2009).*

*Primary Examiner* — Jianying C Atkisson
*Assistant Examiner* — Jose O Class-Quinones
(74) *Attorney, Agent, or Firm* — Harness, Dickey & Pierce, P.L.C.

(57) ABSTRACT

An end tab for a heat exchanger frame includes a plate, an end, an expansion portion, and a bent portion. The plate has a first width, and the end has a second width larger than the first width. The expansion portion increases the width from the first width to the second width. The bent portion connects the plate and the end and includes at least one window.

20 Claims, 3 Drawing Sheets

(56) References Cited

U.S. PATENT DOCUMENTS

| | | | | |
|---|---|---|---|---|
| 2007/0012424 | A1* | 1/2007 | Kamiya | F28D 1/05366 165/81 |
| 2009/0151918 | A1 | 6/2009 | Hur et al. | |
| 2009/0188653 | A1 | 7/2009 | Xu | |
| 2012/0018135 | A1 | 1/2012 | Ciaffarafa et al. | |
| 2012/0024508 | A1 | 2/2012 | Kroetsch et al. | |

* cited by examiner

SIDE PLATE END TAB FOR HEAT EXCHANGER

FIELD

The present disclosure relates to an end tab on a side plate for a heat exchanger, and, more specifically, to a wide windowed end tab for crimping and thermal durability improvement.

BACKGROUND

This section provides background information related to the present disclosure which is not necessarily prior art.

Heat exchangers, such as radiators typically include a core, an inlet tank, and an outlet tank. A plurality of tubes extend the length of the core and transport coolant from the engine and across the core for cooling. Fins extend in a sinusoidal pattern between the radiator tubes to disperse heat. Side plates are often connected to the core which crimps to the inlet tank and the outlet tank and provide stability to the radiator assembly. The side plates may be brazed to the core and engaged with the inlet tank or outlet tank at an end tab. The design of the end tab is often driven by the necessary tooling.

SUMMARY

This section provides a general summary of the disclosure, and is not a comprehensive disclosure of its full scope or all of its features.

An example end tab for a heat exchanger frame according to the present teachings includes a plate, an end, an expansion portion, and a bent portion. The plate has a first width, and the end has a second width larger than the first width. The expansion portion increases the width from the first width to the second width. The bent portion connects the plate and the end and includes at least one window.

The end tab may further include a plurality of projections extending from the end and separated by a gap.

Each of the plurality of projections may further include an angled interior wall adjacent to the gap.

The angled interior wall of each projection may be at an angle between 0° and 90° with respect to an axis through a length of the plate.

The bent portion may further include at least two bends such that the bent portion is a Z-shaped portion.

The at least one window may be two windows disposed symmetrically on either side of an axis through a length of the plate.

The expansion portion may further include angled sides extending at angles with respect to an axis through a length of the plate and defining a slope of an expansion from the first width to the second width.

The angled sides may each extend at an angle between 0° and 90° with respect to the axis.

The second width may be between 10% and 100% larger than the first width.

An example heat exchanger according to the present teachings may include a core and a frame. The core has at least one conduit and a plurality of fins. The frame supports the core and further includes a first tank having a first header plate, a second tank having a second header plate, and a side plate connecting the first tank and the second tank. The side plate includes an end tab connecting the side plate to one of the first header plate and the second header plate. The end tab further includes a plate, an end, an expansion portion, and a bent portion. The plate has a first width, and the end has a second width larger than the first width. The expansion portion increases the width from the first width to the second width. The bent portion connects the plate and the end and includes at least one window.

The heat exchanger may further include a plurality of projections that extend from the end, are separated by a gap, and are configured to locate the end tab on the one of the first header plate and the second header plate.

Each of the plurality of projections may further include an angled interior wall adjacent to the gap. The angled interior wall may be configured to guide a center tab of the one of the first header plate and the second header plate into the gap to locate the end tab on the one of the first header plate and the second header plate.

The angled interior wall of each projection may be at an angle between 0° and 90° with respect to an axis through a length of the plate.

The bent portion may further include at least two bends such that the bent portion is a Z-shaped portion configured to extend over the one of the first header plate and the second header plate.

The at least one window may be two windows disposed symmetrically on either side of an axis through a length of the plate such that during a crimping process of the end tab onto the one of the first header plate and the second header plate, a crimp arm extends through each window and engages the one of the first header plate and the second header plate.

The second width may be between 10% and 100% larger than the first width.

The bent portion may further include two bends, and the at least one window may be disposed in both bends.

The expansion portion may further include angled sides extending at angles with respect to an axis through a length of the plate and defining a slope of an expansion from the first width to the second width.

The angled sides may each extend at an angle between 0° and 90° with respect to the axis.

An example cooling system according to the present teachings may include a heat exchanger configured to decrease a temperature of a fluid in the cooling system. The heat exchanger may further include a core and a frame. The core has at least one conduit and a plurality of fins. The frame supports the core and further includes a first tank having a first header plate, a second tank having a second header plate, and a side plate connecting the first tank and the second tank. The side plate includes an end tab connecting the side plate to one of the first header plate and the second header plate. The end tab further includes a plate, and end, an expansion portion, a bent portion, and a plurality of projections. The plate has a first width. The end has a second width larger than the first width. The expansion portion increases the width from the first width to the second width. The bent portion connects the plate and the end and includes at least one window. The plurality of projections extend from the end, are separated by a gap, and are configured to locate the end tab on the one of the first header plate and the second header plate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
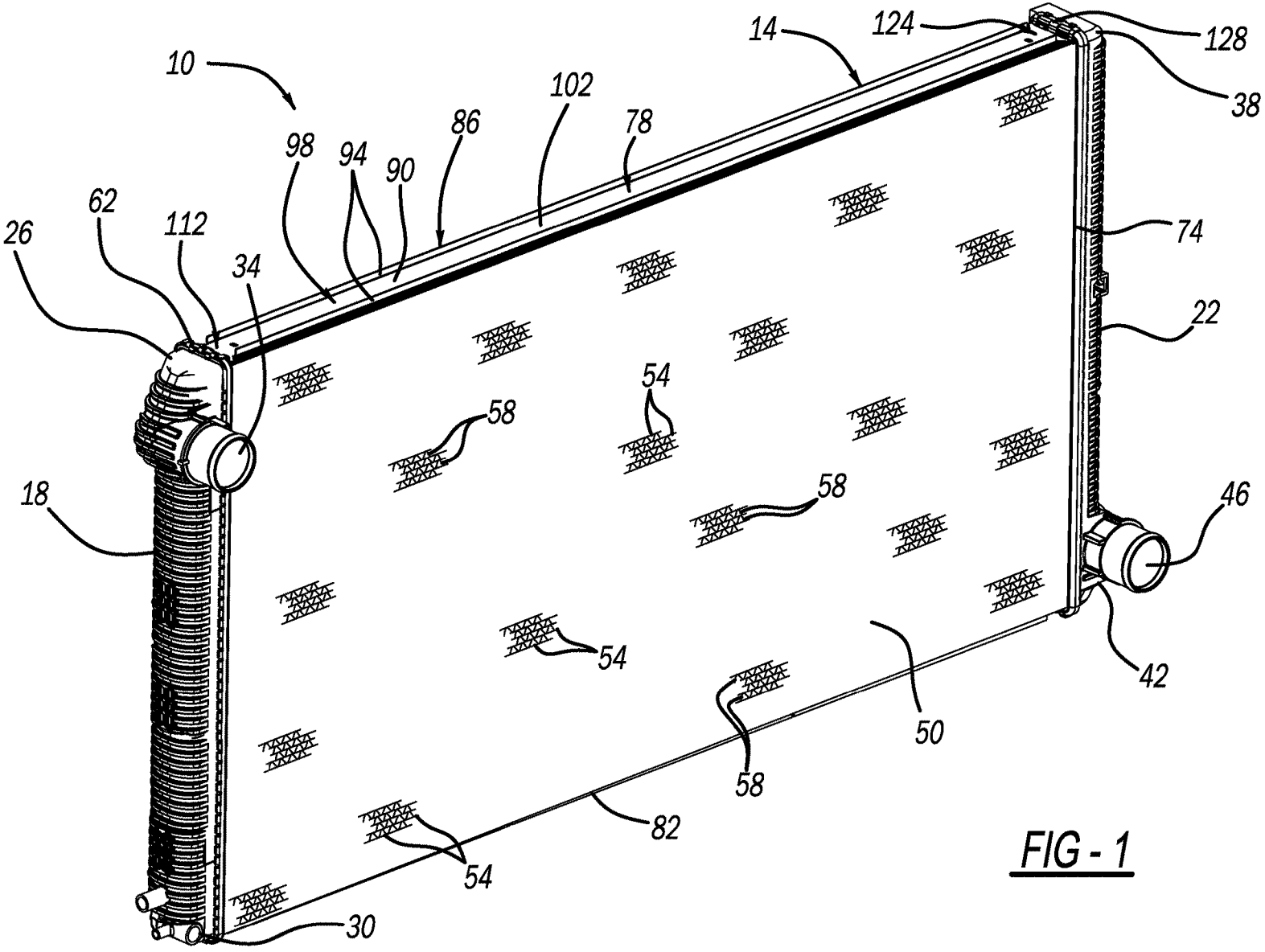
FIG. 1 is a perspective view of an example heat exchanger according to the present disclosure.
Figure 2:
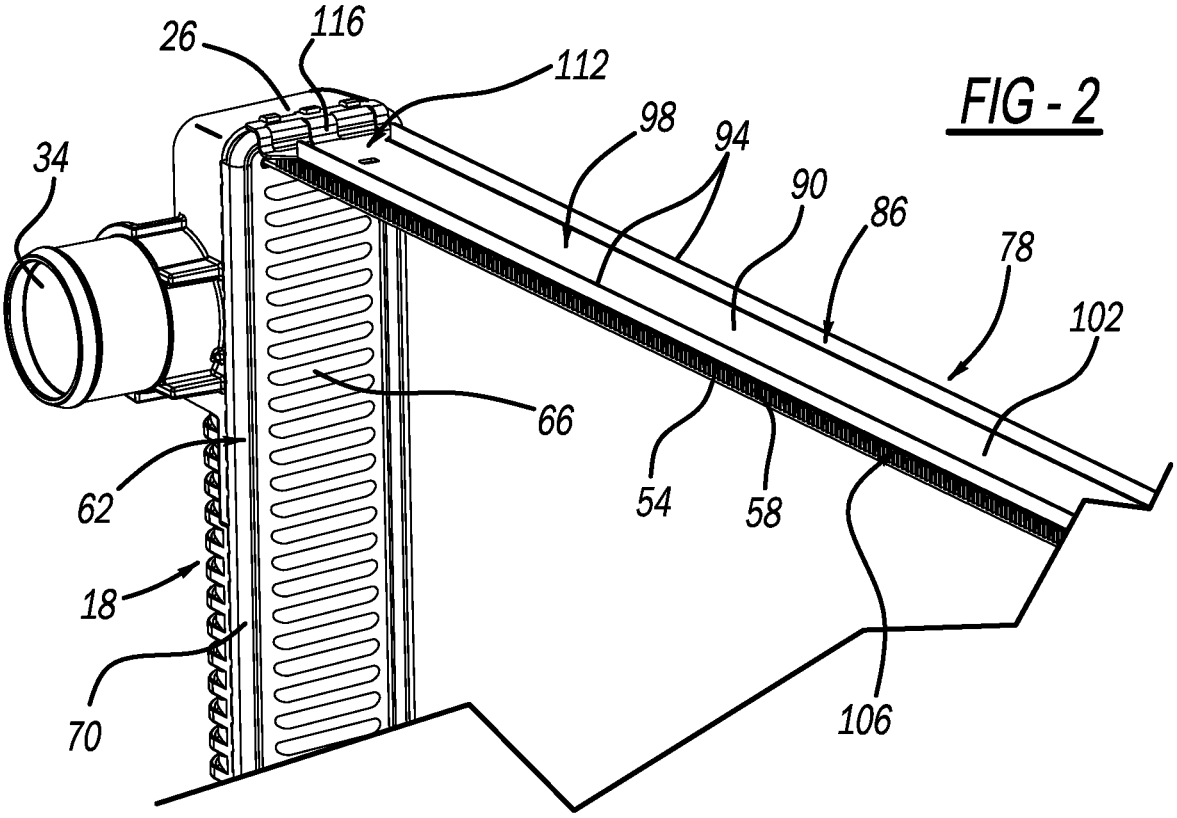
FIG. 2 is a section view of the heat exchanger in FIG. 1 according to the present disclosure.
Figure 3:
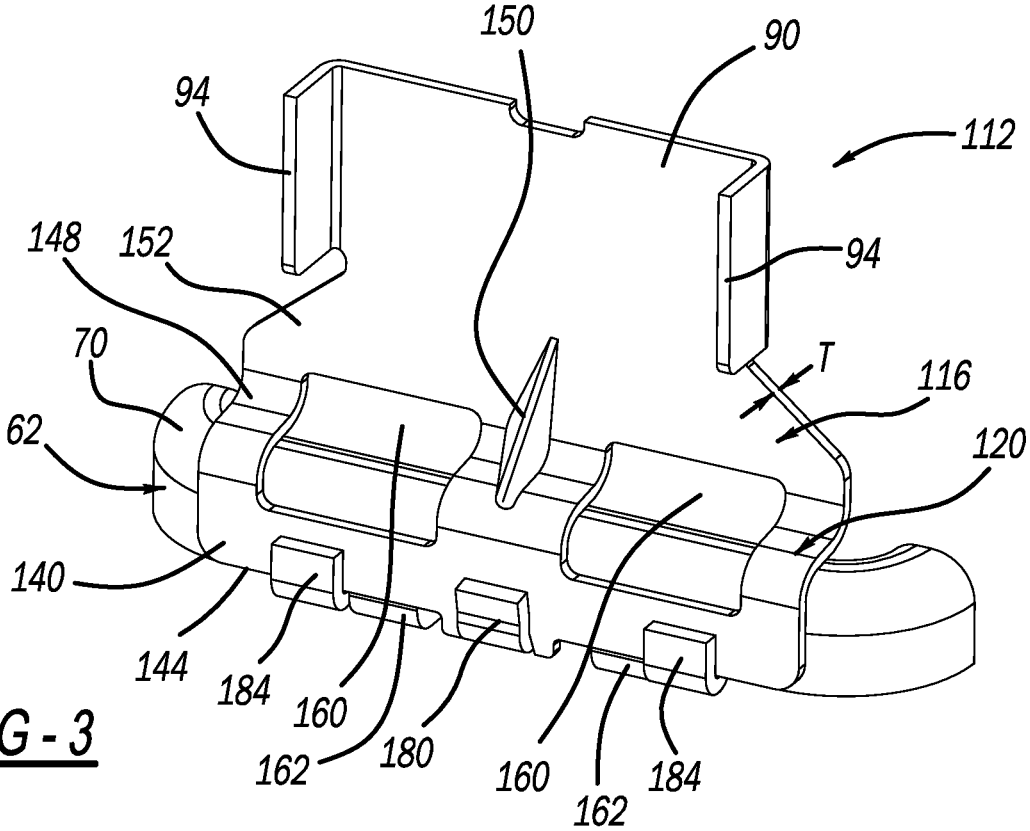
FIG. 3 illustrates an engagement between an end tab and a header plate of FIG. 1 according to the present disclosure.

With reference to FIGS. 1-3 a heat exchanger, such as a radiator, 10 for a cooling system is illustrated. The cooling system may be suitable for cooling any suitable device, such as a vehicle engine. The engine may be installed in a vehicle, or the cooling system is suitable for cooling any suitable non-vehicular engine as well. With respect to vehicles, the engine may power a passenger vehicle or any other suitable vehicle, such as any recreational vehicle, mass transit vehicle, military vehicle, construction vehicle/equipment, watercraft, aircraft, etc.

The radiator 10 includes a frame 14 incorporating a first tank 18 and a second tank 22 of the radiator 10. The first tank 18 may be an inlet tank and includes an upper end 26 and a lower end 30. The first tank 18 also includes an inlet 34, which, in the example illustrated, is closer to the upper end 26 than the lower end 30. Coolant is introduced into the first tank 18 through the inlet 34. Thus the inlet 34 can be connected to a coolant tube (not shown), which extends from the engine to the inlet 34.

The second tank 22 of the radiator 10 may be an outlet tank and includes an upper end 38 and a lower end 42. The second tank 22 has an outlet 46, which, in the example illustrated, is closer to the lower end 42 than the upper end 38. Coolant can exit the second tank 22 through the outlet 46. Thus, the outlet 46 can be connected to a coolant tube (not shown), which transports coolant away from the second tank 22.

In other embodiments, the radiator 10 may be a multi-radiator or multi-flow radiator where the first tank 18 and the second tank 22 are each internally separated, with each tank 18, 22 including an inlet and an outlet. In this configuration, the upper end 26 of the first tank 18 includes the inlet 34, the upper end 38 of the second tank 22 includes the outlet 46, the lower end 42 of the second tank 46 includes a second inlet, and the lower end 30 of the first tank 18 includes a second outlet.

The first tank 18 and the second tank 22 may be formed of a polymer, such as plastic. For manufacturing purposes, the first tank 18 and the second tank 22 may be injection molded. While plastic tanks are discussed, it is understood that the disclosure is not limited to plastic tanks and may be applicable to tanks of any material (for example only, such as metal or ceramic).

Between the first tank 18 and the second tank 22 is a core 50 of the radiator 10. The core 50 includes a plurality of coolant conduits 54 extending between the first tank 18 and the second tank 22. The coolant conduits 54 of the core 50 transport coolant from the first tank 18 to the second tank 22. Between the coolant conduits 54 are a plurality of fins 58 for dispersing heat. The fins 58 may extend in a sinusoidal pattern between the first tank 18 and the second tank 22. While a sinusoidal pattern is illustrated and discussed, it is understood that the fins may extend between the first tank 18 and the second tank 22 in any configuration that disperses heat from the coolant conduits 54.

Fixing the first tank 18 to the core 50 is a first-side header plate 62. The header plate 62 includes a plurality of apertures 66 (FIG. 2) that align with the cooling conduits 54 of the core 50. An outer ring 70 encircles the plurality of apertures 66 and defines an outer edge of the header plate 62. The first-side header plate 62 provides a water-tight joint to the accompanying first tank 18. The first-side header plate 62 may be formed of a polymer, such as plastic, a metal (for example only, an aluminum alloy), or any other material. Depending on the material, the header plate 62 may be soldered, welded, crimped, or otherwise fixed to the first tank 18.

Fixing the second tank 22 to the core 50 is a second-side header plate 74. Like the first-side header plate 62, the second-side header plate 74 includes a plurality of apertures 66 that align with the cooling conduits 54 of the core 50. An outer ring 70 encircles the plurality of apertures 66 and defines an outer edge of the header plate 74. The second-side header plate 74 provides a water-tight joint to the accompanying second tank 22. The second-side header plate 74 may be formed of a polymer, such as plastic, a metal (for example only, an aluminum alloy), or any other material. Depending on the material, the header plate 74 may be soldered, welded, crimped, or otherwise fixed to the second tank 22.

Connecting the upper end 26 of the first tank 18 (and first-side header plate 62) to the upper end 38 of the second tank 22 (and second-side header plate 74) is a side plate 78. Connecting the lower end 30 of the first tank 18 (and first-side header plate 62) to the lower end 42 of the second tank 22 (and second-side header plate 74) is a side plate 82. Side plates 78 and 82 may include the same features, positioned at mirror images. Accordingly, the features of side plate 78 are discussed and may be applied to side plate 82.

Side plate 78 may include a body 86 having a plate 90 and side walls 94 forming a channel 98. The side walls 94 extend from the plate 90 on a top side 102 of the plate 90. A bottom side 106 of the plate 90, opposite the top side 102, contacts the fins 58 of the core 50. The body 86 may be formed of a metal, such as, for example, an aluminum alloy. While a metal is discussed, it is understood that the body 86 is not limited to a metal, but may be formed of a polymer, or any other material providing structure between the first tank 18 and second tank 22.

A first end 112 of the side plate 78 engages the first-side header plate 62. The first end 112 of the side plate 78 may include an end tab 116 having an "Z"-shaped portion 120. A second end 124 of the side plate 78 engages the second-side header plate 74. The second end 124 may include an end tab 128 similar to the end tab 116 of the first end 112. End tabs 128 and 116 may include the same features, positioned at mirror images. Accordingly, the features of end tab 116 are discussed and may be applied to end tab 128.

Figure 4A:
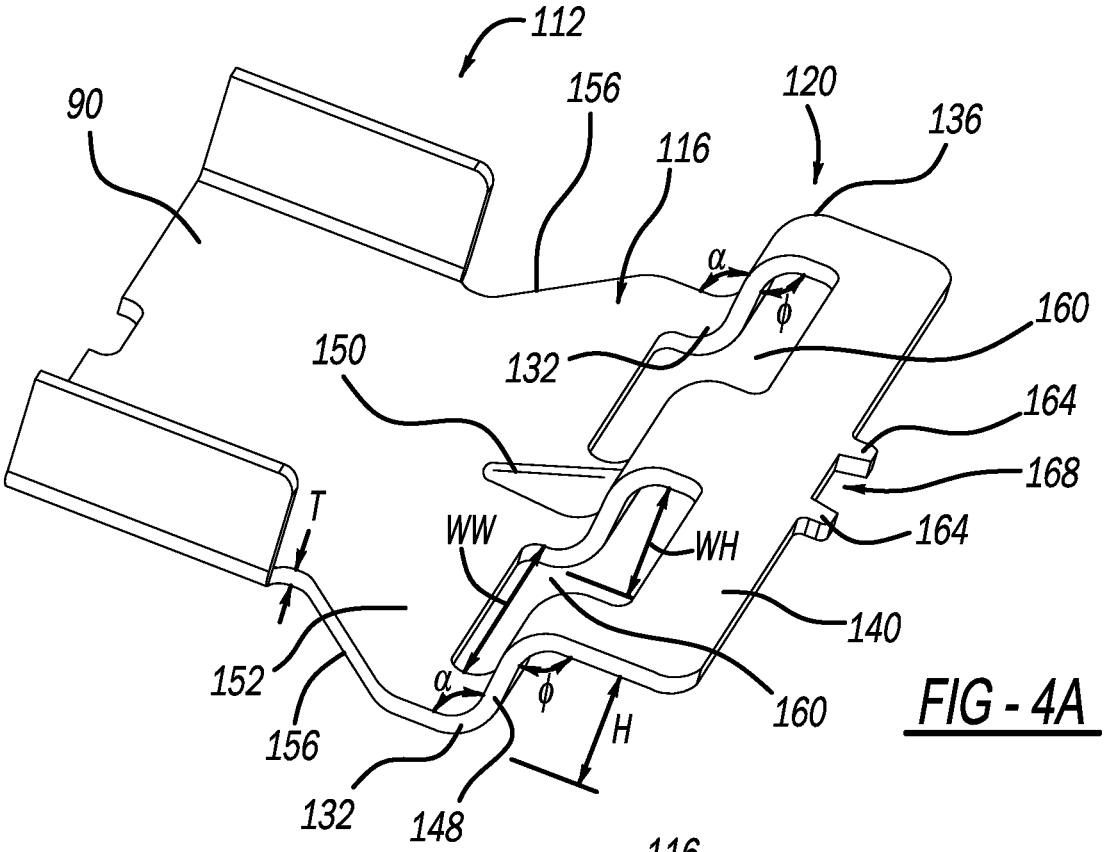
FIG. 4A is a perspective view of an example end tab according to the present disclosure.
Figure 4B:
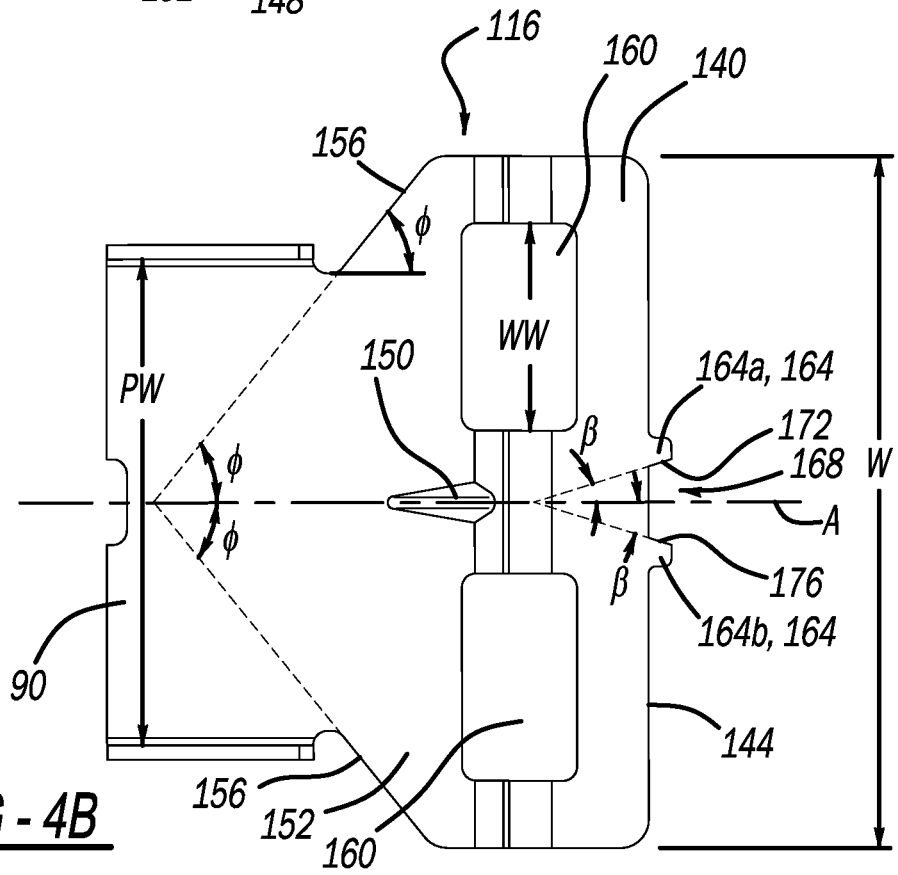
FIG. 4B is a top view of the end tab of FIG. 4A according to the present disclosure.

Now referring to FIGS. 3-4B, the end tab 116 is illustrated. The end tab 116 may be formed of a metal, such as, for example, an aluminum alloy. While a metal is discussed, it is understood that the end tab 116 is not limited to a metal, but may be formed of a polymer, or any other material. Preferably, the end tab 116 is formed of the same material as the body 86 of the side plate 78.

The end tab 116 may have a uniform thickness T throughout its length. The thickness T may be equal to or greater than a thickness of the plate 90 of the side plate 78. Additionally, the thickness T may be determined to provide thermal durability to the core plate 50, cooling conduits 54, and/or fins 58. In some embodiments, increasing the thickness T may result in a reduction in thermal stress. For example only, the thickness T may be within a range of 0.5 mm to 2 mm.

As previously stated, the end tab 116 includes the "Z"-shaped portion 120. The Z-shaped portion 120 may include a first bend 132 (from which the Z-shaped portion extends) and a second bend 136. The first bend 132 may be formed at an angle $\alpha$ and the second bend 136 may be formed at an angle 4). A sum of the angles $\alpha$ and $\phi$ may be 180 degrees (°). In some embodiments, a straight portion 140 following the second bend 136 extends in a plane parallel with a plane of the plate 90. In other embodiments, the straight portion 140 following the second bend 136 may be angled relative to the plane of the plate 90. Additionally, the first bend 132 and the second bend 136 may be angled such that the Z-shaped portion 120 extends around the outer ring 70 of the first-side header plate 62. For example only, the angle $\alpha$ of the first bend 132 and the angle $\phi$ of the second bend 136 may each be equal to 90°.

Due to the first bend 132 and the second bend 136 of the Z-shaped portion 120, the straight portion 140 may be at a height H relative to the plate 90. The height H may be sized such that the Z-shaped portion 120 extends around the outer ring 70 of the first-side header plate 62. The height H may be equal to a portion 148 of the end tab 116 extending between the first bend 132 and the second bend 136. For example only, the height H of the Z-shaped portion may be within a range of 5 mm-10 mm, and, more particularly, within a range of 6.5 mm to 7.5 mm.

In some embodiments, a rib 150 may be disposed to support the Z-shaped portion 120. For example, the rib 150 may be disposed in the center of the Z-shaped portion 120. In other examples, more than one rib 150 may support the Z-shaped portion 120 and may be disposed at any location along the Z-shaped portion 120, such as on the sides and/or in the center. The rib 150 may engage with the plate portion 90 or an expansion portion 152 (described below) and the portion 148. Additionally, the rib 150 may be triangularly shaped, with a hypotenuse connecting the plate portion 90 or expansion portion 152 and the portion 148. Although the figures include the rib 150, it is understood that the rib 150 may not be necessary and, therefore, may not be included.

Referring to FIG. 4B, the end tab 116 may expand from a width PW of the plate 90 to a width W of an end 144 of the end tab 116. The width PW may be, for example, one or more of equal to a width of the core 50, equal to a width of the first-side header plate 62, wider than a width of the apertures 66, and wider than a width of the coolant conduits 54. The width W may be, for example, one or more of grater than a width of the core 50, equal to a width of the first-side header plate 62, wider than a width of the apertures 66, and wider than a width of the coolant conduits 54. For example only, the width W of the end 144 may be 10%-100% larger than the width PW of the plate 90, and, in some embodiments, the width W may be 50%-70% larger than the width PW. Thus, in an example embodiment, if a width PW of the plate 90 is 30 mm, the width W of the end 144 may be 50 mm. Increasing the width from the width PW to the width W may result in a reduction in thermal stress.

An expansion portion 152 may be disposed between the plate 90 and the Z-shaped portion 120 where the width PW of the plate 90 expands to the width W of the end 144. The expansion portion 152 may have angled sides 156 that define how quickly the width PW expands to the width W. As such, the angled sides 156 may extend at an angle $\theta$ relative to an axis A along which the plate 90 and end tab 116 extend. For example only, the angle $\theta$ may be within a range of 0° to 90°, and, in some embodiments, the angle $\theta$ may be between 45° and 60°.

A plurality of windows (for example only, 2 windows) 160 may be disposed in at least one of the first bend 132 and the second bend 136 of the Z-shaped portion 120. In some embodiments, the plurality of windows 160 may extend through both the first bend 132 and the second bend 136 of the Z-shaped portion 120. The windows 160 may be disposed symmetrically on opposite sides of the axis A. The windows 160 may provide openings in the end tab 116 for a crimping arm (not shown) of an external crimping machine (not shown) to crimp tabs 162 of the core 50 to the first tank 18. The crimping arm (not shown) may extend through the window 160 and engage the first-side header plate 62 such that the first-side header plate 62 may provide a pivot point for the crimping arm.

Each window 160 may be a height WH and width WW that is slightly larger than a height and width of the crimping arm (not shown). For example only, the height WH and width WW of each window 160 may be 10%-100% larger than the height and width of the crimping arm, 15%-30% larger than the height and width of the crimping arm, or, in some embodiments, the height WH of the window 160 may be 10 mm and the width WW of the window may be 15 mm when the height of the crimping arm is 8 mm and the width of the crimping arm is 12 mm.

A shape of each of the windows 160 in a plan view (for example, FIG. 4B) may be rectangular with rounded corners. Although the shape is illustrated as rectangular in FIG. 4B, the shape may be any shape that mirrors a shape of the crimping arm in the plan view. For example, if the shape of the crimping arm in the plan view is trapezoidal, triangular, circular or any other shape, the shape of each window 160 will also be trapezoidal, triangular, circular or any other shape, respectively.

A plurality of projections (for example, 2 projections) 164 may extend from the end 144 of the end tab 116. The projections 164 may extend along the same plane as the plane of the straight portion 140. A gap 168 may separate the projections 164. An interior wall 172 of a first 164*a* of the projections 164 may be disposed on a side of the projection 164*a* adjacent to the gap 168, and an interior wall 176 of a second 164*b* of the projections 164 may be disposed on a side of the projection 164*b* adjacent to the gap 168. The interior wall 172 may be opposite the gap 168 from the interior wall 176. The interior walls 172, 176 may extend from the end 144 at opposite, but equal, angles β relative to the axis A. The angled interior walls 172, 176 may provide a guide for inserting the end tab 116 onto the first-side header plate 62. For example, the angles β may be within a range of 0° to 90°, and, in some embodiments, within a range of 10° to 45°.

With reference to FIGS. 1-3, during installation, the first tank 18 is assembled onto the first-side header plate 62. The header plate 62 may include a center tab 180 and side tabs 184 that are originally extending along a plane parallel to a plane of the first-side header plate 62. The end tab 116 may be aligned with the first-side header plate 62 such that the center tab 180 of the first-side header plate 62 is positioned in the gap 168 and the side tabs 184 align with the windows 160. In other configurations, the plurality of projections 164 may be positioned on opposing ends of the end 144 of the end tab 116 such that the center tab 180 and the side tabs 184 are positioned in the gap 168. In still other configurations, the plurality of projections 164 may include two pairs of projections that are positioned such that, when installed, each of the side tabs 184 are positioned in a gap 168 of one of the two pairs of projections. In still other configurations, the plurality of projections 164 may include three pairs of projections that are positioned such that, when installed, each of the center tab 180 and the side tabs 184 are positioned in a gap 168 of one of the three pairs of projections.

As the end tab 116 is engaged with the first-side header plate 62, the interior walls 172, 176 of the projections 164 guide the center tab 180 into position. Because of the fixed position between the center tab 180 and the side tabs 184, the side tabs 184 fall into alignment with the windows 160 as the center tab 180 is guided into the gap 168. Once the end tab 116 is inserted into position on the first-side header plate 62, the assembly is ready for brazing (before being engaged with the core). Once the end tab 116 and the first-side header plate 62 are brazed together, the tank is crimped onto the core 50. The crimping arm is inserted within the window 160 to contact the outer ring 70 and support the first-side header plate 62. A punch is used to fold each of the tabs 162 of the core 50 to the first tank 18, crimping the core 50 thereto.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An end tab for a heat exchanger frame comprising:

a plate having a first width;

an end having a second width larger than the first width;

an expansion portion increasing the width from the first width to the second width; and a bent portion connecting the expansion portion and the end and including at least one window, the bent portion having the second width.

2. The end tab of claim 1, further comprising a plurality of projections extending from the end and separated by a gap.

3. The end tab of claim 2, wherein each of the plurality of projections includes an angled interior wall adjacent to the gap.

4. The end tab of claim 3, wherein the angled interior wall of each projection is at an angle between 0° and 90° with respect to an axis through a length of the plate.

5. The end tab of claim 1, wherein the bent portion includes at least two bends such that the bent portion is a Z-shaped portion.

6. The end tab of claim 1, wherein the at least one window is two windows disposed symmetrically on either side of an axis through a length of the plate.

7. The end tab of claim 1, wherein the expansion portion includes angled sides extending from the first width to the second width, the angled sides extending at angles with respect to an axis through a length of the plate and defining a slope of an expansion from the first width to the second width, the angled sides consistently increasing the width from the first width to the second width.

8. The end tab of claim 7, wherein the angled sides each extend at an angle between 45° and 60° with respect to the axis.

9. The end tab of claim 1, wherein the second width is between 10% and 100% larger than the first width.

10. A heat exchanger comprising:

a core having at least one conduit and a plurality of fins; and a frame supporting the core, wherein the frame includes:

a first tank having a first header plate, a second tank having a second header plate, and a side plate connecting the first tank and the second tank, wherein the side plate includes an end tab connecting the side plate to one of the first header plate and the second header plate, the end tab including:

a plate having a first width;

an end having a second width larger than the first width;

an expansion portion increasing the width from the first width to the second width; and a bent portion connecting the expansion portion and the end and including at least one window, the bent portion having the second width.

11. The heat exchanger of claim 10, further including a plurality of projections extending from the end and separated by a gap, the plurality of projections being configured to locate the end tab on the one of the first header plate and the second header plate.

12. The heat exchanger of claim 11, wherein each of the plurality of projections includes an angled interior wall adjacent to the gap, the angled interior wall configured to guide at least one tab of the one of the first header plate and the second header plate into the gap to locate the end tab on the one of the first header plate and the second header plate.

13. The heat exchanger of claim 12, wherein the angled interior wall of each projection is at an angle between 0° and 90° with respect to an axis through a length of the plate.

14. The heat exchanger of claim 10, wherein the bent portion includes at least two bends such that the bent portion is a Z-shaped portion configured to extend over the one of the first header plate and the second header plate.

15. The heat exchanger of claim 10, wherein the at least one window is two windows disposed symmetrically on either side of an axis through a length of the plate such that during a crimping process of the end tab onto the one of the first header plate and the second header plate, a crimp arm extends through each window and engages the one of the first header plate and the second header plate.

16. The heat exchanger of claim 15, wherein the bent portion is solid along the axis through the length of the plate and includes a rib extending along the axis through the length of the plate, the rib being aligned with a center tab of the one of the first header plate and the second header plate.

17. The heat exchanger of claim 10, wherein the bent portion includes two bends and the at least one window is disposed in both bends.

18. The heat exchanger of claim 10, wherein the expansion portion includes angled sides extending from the first width to the second width, the angled sides extending at angles with respect to an axis through a length of the plate and defining a slope of an expansion from the first width to the second width, the angled sides consistently increasing the width from the first width to the second width.

19. The heat exchanger of claim 18, wherein the angled sides each extend at an angle between 0° and 90° with respect to the axis.

20. A cooling system comprising:

a heat exchanger configured to decrease a temperature of a fluid in the cooling system, the heat exchanger further comprising:

a core having at least one conduit and a plurality of fins; and a frame supporting the core, wherein the frame includes:

a first tank having a first header plate, a second tank having a second header plate, and a side plate connecting the first tank and the second tank, wherein the side plate includes an end tab connecting the side plate to one of the first header plate and the second header plate, the end tab including:

a plate having a first width;

an end having a second width larger than the first width;

an expansion portion increasing the width from the first width to the second width; and a bent portion connecting the extension portion and the end and including at least one window, the bent portion having the second width; and a plurality of projections extending from the end and separated by a gap, the plurality of projections being configured to locate the end tab on the one of the inlet header plate and the outlet header plate.

* * * * *